US005333146A

United States Patent [19]

Vance

[11] Patent Number: 5,333,146

[45] Date of Patent: * Jul. 26, 1994

[54] ON-SITE, BIOHAZARDOUS WASTE DISPOSAL SYSTEM

[76] Inventor: Murry Vance, 6751 Gadwall La., Orlando, Fla. 32810

[ * ] Notice: The portion of the term of this patent subsequent to Jun. 29, 2010 has been disclaimed.

[21] Appl. No.: 83,893

[22] Filed: Jun. 28, 1993

Related U.S. Application Data

[63] Continuation of Ser. No. 919,449, Jul. 27, 1992, Pat. No. 5,224,118.

[51] Int. Cl.[5] ..... H05B 7/18; F27D 1/00

[52] U.S. Cl. ..... 373/60; 219/383; 588/900; 110/250; 373/9

[58] Field of Search ..... 373/60, 81, 9; 219/383, 219/384; 588/900, 228, 209, 213, 216, 220; 110/250

[56] References Cited

U.S. PATENT DOCUMENTS

| | | | |
|---|---|---|---|
| 3,779,182 | 12/1973 | Camacho | 110/250 |
| 3,996,044 | 12/1976 | Petritsch | 75/10.43 |
| 4,419,943 | 12/1983 | Faurholdt | 110/255 |
| 4,451,925 | 5/1984 | Sandoval | 373/81 |
| 4,770,109 | 9/1988 | Schlienger | 110/250 |

FOREIGN PATENT DOCUMENTS

| | | | |
|---|---|---|---|
| 2196099 | 4/1988 | United Kingdom | 110/250 |

*Primary Examiner*—Bruce A. Reynolds
*Assistant Examiner*—John A. Jeffery
*Attorney, Agent, or Firm*—Warren L. Franz

[57] ABSTRACT

An incinerator for the disposal of biohazardous waste has a sealed enclosure defining a combustion chamber with upper, first level intermediate, second level intermediate and lower portions. The upper chamber portion is an inclined chute with a door into which a plurality of cylindrical metal containers of waste are loaded. The bottom run of the chute has a stepped, centrally expanding dimension so different sized containers will be self-centered. A pair of laterally-spaced drums is disposed in the first level intermediate portion, at a constriction which stops further descent down the chute of the leading container. Banks of first level TIG torches are arranged to arc to the drums, providing heat for "cooking" waste in the unopened containers in the upper portion with rising gases and for opening the leading container and incandescently acting on solid materials spilled therefrom. A large ribbed drum, laterally-spaced from another drum, in the second level intermediate portion provides a second more secure constriction to limit the size of particles passed to a solid residue collection hopper in the lower portion. Second level TIG torches are to the second level drums to further act on the waste. Heated gases are collected at the top of the chute and recirculated to the second level intermediate portion. Heavier gases are passed to scrubbers, and the hopper is emptied to a residue discharge bin in the lower chamber portion. The torches are cyclically fired by high voltage delivered sequentially from coils by distributors, and sustained by direct connections through diode arrays to common power sources. The cyclic firing provides mechanical agitation to the waste during processing, and common electrode arrangements redirect power to clear shorts.

20 Claims, 5 Drawing Sheets

POWER SUPPLY
460V AC
CPU 115VAC
141
115VAC
460VAC IN
109
122
123
CPU
115V AC
118
DC
IN
OUT
117
121
+24VDC
116
111
115
114
112
113
110
38
37
30b
107
142
36
35
119
M
GAS IN
128
129
59
42
40
41
39
30a
106

ON-SITE, BIOHAZARDOUS WASTE DISPOSAL SYSTEM

This application is a continuation of application Ser. No. 07/919,449, filed Jul. 27, 1992, pending.

This invention relates generally to a system for processing waste; and, in particular, to a system for the on-site processing of biohazardous waste into solid nonhazardous material at a hospital, medical lab or similar location where the waste is generated.

BACKGROUND OF THE INVENTION

Conventional on-site disposal of biohazardous waste involves two types of processes: those which disinfect, sterilize or decontaminate; and those which destroy, shred, contain or grind. The first of these are aimed at destroying or irreversibly inactivating germs, viruses, and other harmful micro-organisms which might otherwise cause illness to humans or damage the environment. The second are aimed at precluding the possibility of reuse, injury, or improper end material disposal.

Most existing on-site disposal systems satisfy only one of these objectives and must be combined with additional offsite processing to complete the safe disposal of the biohazardous waste. Such systems have the disadvantage that they require the transportation and handling of biohazardous materials between the different steps required to render the waste safely disposable. Each handling occurrence adds to the chance for human or environmental contamination.

An alternative procedure for biohazardous waste disposal has been to transport the waste to a remote open air or forced air controlled combustion incinerator for processing. The biohazardous waste is disposed of through incineration at temperatures of 1800° F., or more, for an accepted retention time of at least one minute. Such combustible flame burning techniques, however, produce and discharge their own hazardous gas waste and ash directly into the atmosphere and environment. They also require the transportation and handling of the untreated waste from the site of generation to the incineration site, which adds to the cost of disposal and increases the chance of mishap.

SUMMARY OF THE INVENTION

It is an object of the present invention to provide a system for the disposal of biohazardous waste which renders the waste non-biohazardous and decomposes the same on site to a nonhazardous, readily manageable solid residue.

It is a further object of the invention to provide a biohazardous waste disposal system which controls the by-products of waste treatment processing so that they do not create a hazard of their own and uses the generated by-products to facilitate their own decomposition.

In one aspect of the invention, an incandescent heat, biohazardous waste disposal system is provided by which the composition of biohazardous waste is changed to render it nonbiohazardous and converted to a solid waste by means of intense incandescent heat electrically generated in a controlled atmosphere. The generated byproducts are used to facilitate the decomposition of the processed waste.

The waste enters the process in metal containers which are gravity fed through a first waste treatment stage where high temperature gases heat the waste, while still in the containers. In a second treatment stage, high temperature gases, generated by low voltage/high amperage electric arc transfer torches in a controlled noble gas atmosphere, open the biohazardous waste containers; reduce waste solid composition to ash residue; heat third stage compactor drums to a controlled temperature of 2200° F.; and incandescently heat the circulating byproduct gases.

The second stage torches are continually ignited by progressive distribution of high voltage/low amperage capacitors arced through diodes to individual torch electrodes. Turbulence from the continued ignition of the torches motivates the waste through the second stage process. Torches are designed with a common anode and shared cathode, which acts as an electrode cleaner. Any small piece of biohazardous waste touching an electrode causes the corresponding arc to greatly increase in amperage and heat intensity. This action quickly burns away any unwanted waste from the torch electrode and sustains the desired flame pattern.

While maintaining a controlled temperature of 2200° F., third stage drum compactors process the biohazardous residue left by the second stage torches through oppositely moving adjacent surfaces of rotating second level compactor drums, until the reside ash is reduced to a controlled size that passes through a nip between the second level drums, and enters the fourth stage collection point.

A fourth stage chamber collects the ash and incorporates a wet scrubbing system to process and discharge remaining byproduct gases. The wet scrubbing system uses water as the motive for cleaning the discharged gases. A byproduct of ozone acts as a disinfectant for germs and viruses which may be present in the water motive. Scrubbed gas is cooled during the process and vented to the atmosphere through a trap and vent pipe, or otherwise suitably locally treated for discharge. Residue ash is removed from a collection bin and discarded as ordinary, non-hazardous solid waste.

BRIEF DESCRIPTION OF THE DRAWINGS

Embodiments of the invention have been chosen for purposes of illustration and description, and are shown in the accompanying drawings, wherein.

Figure 1:
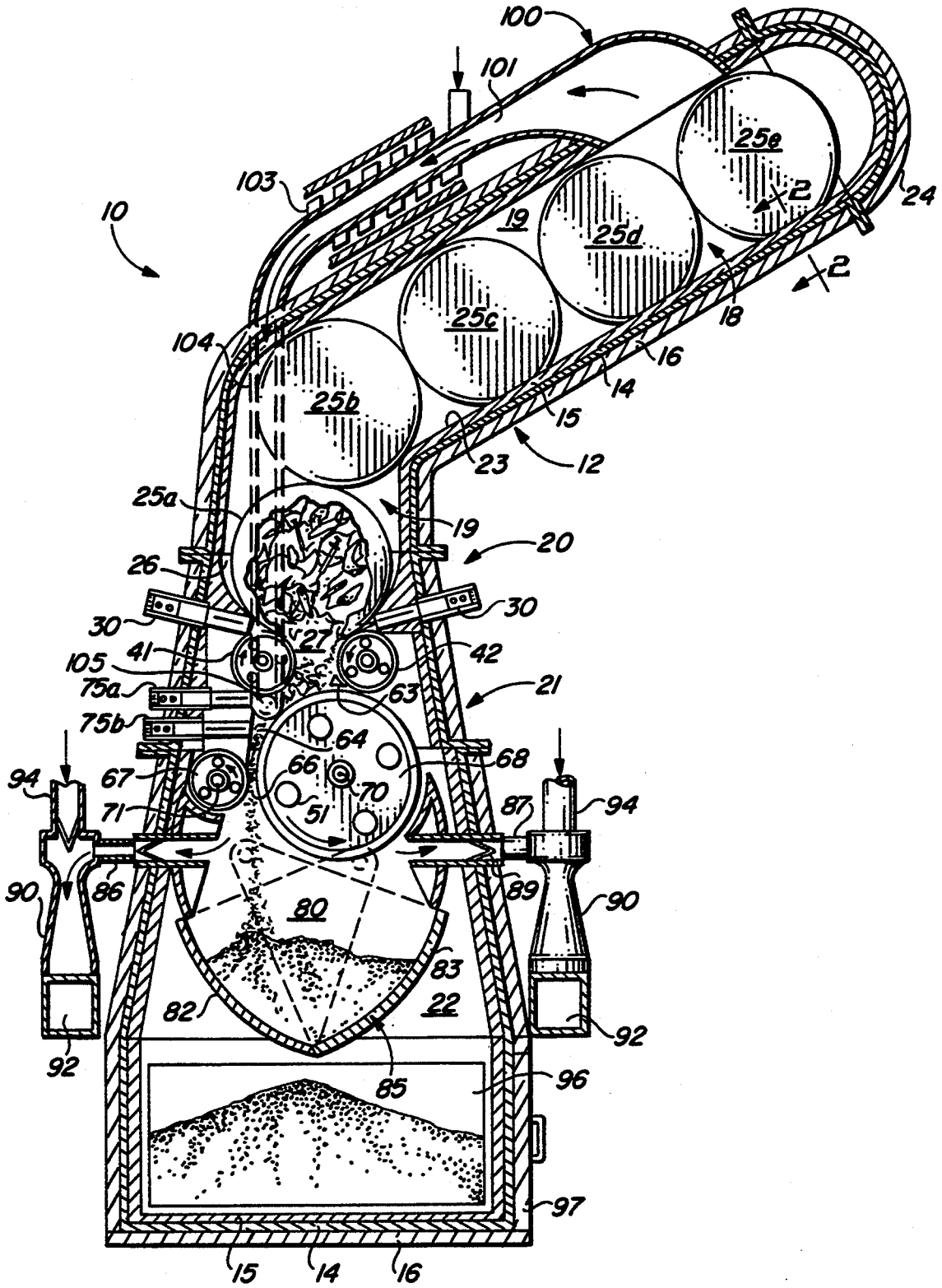
FIG. 1 is a front, vertical section view of an incinerator in accordance with the invention, shown in use for the on-site disposal of biohazardous waste.
Figure 4:
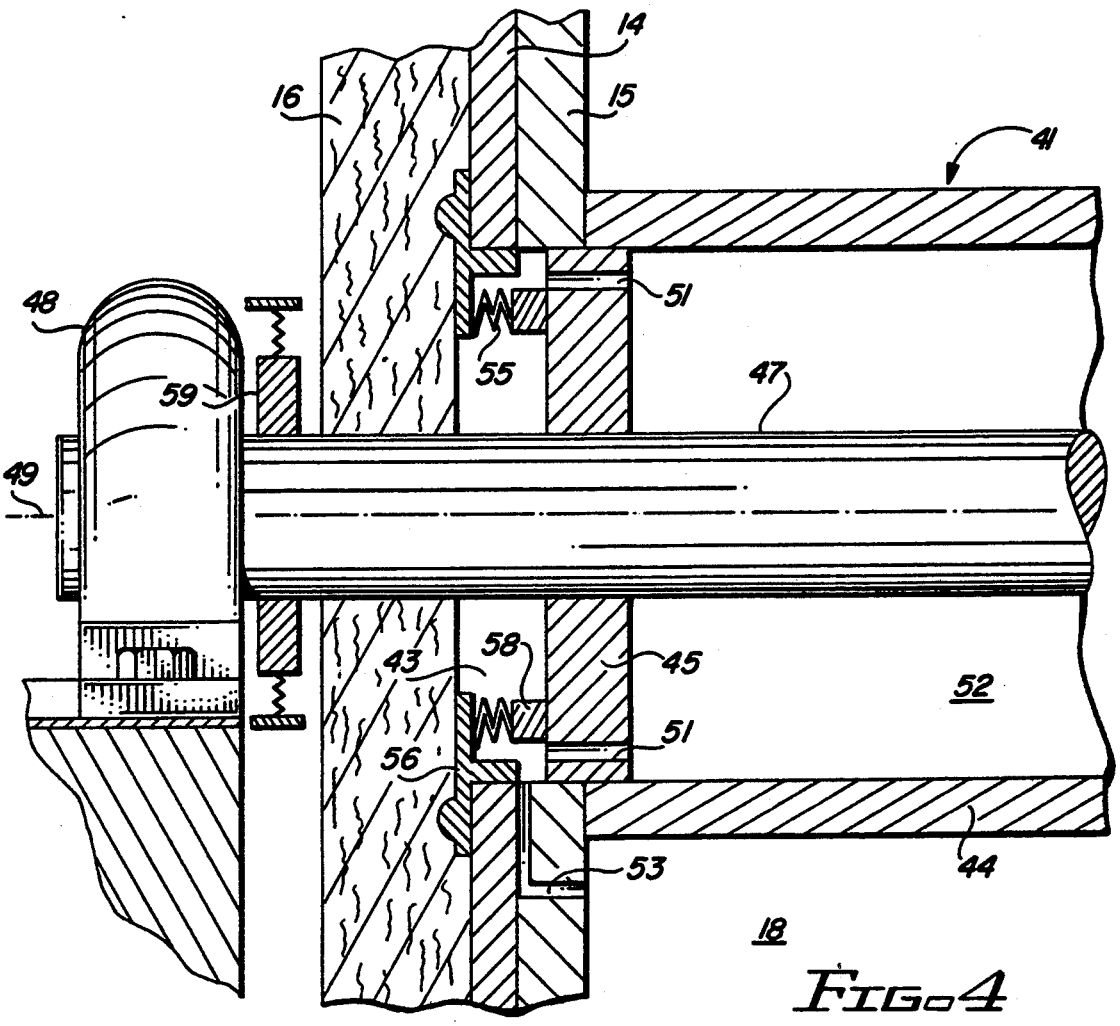
Figure 3:
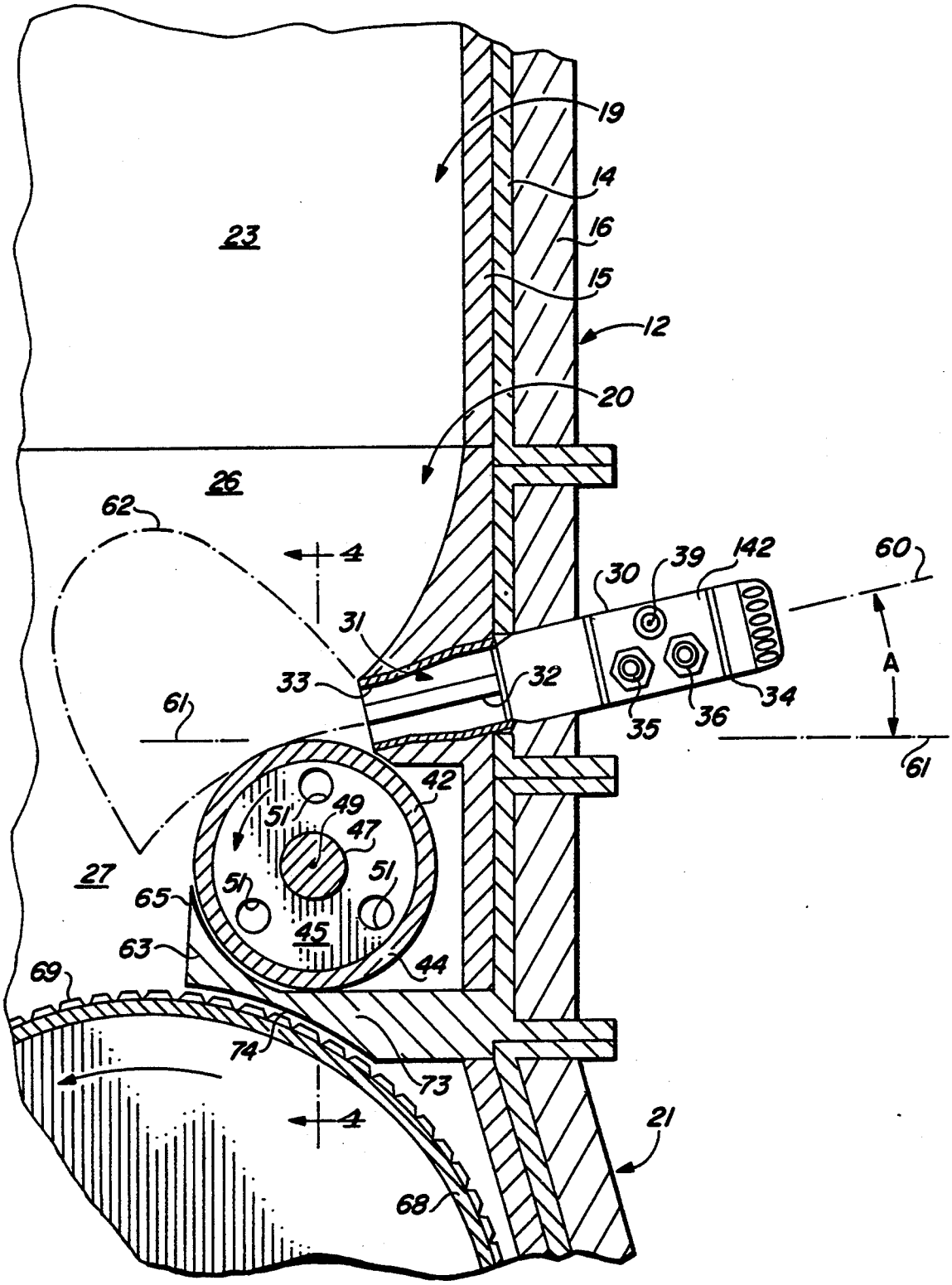
Figure 5:
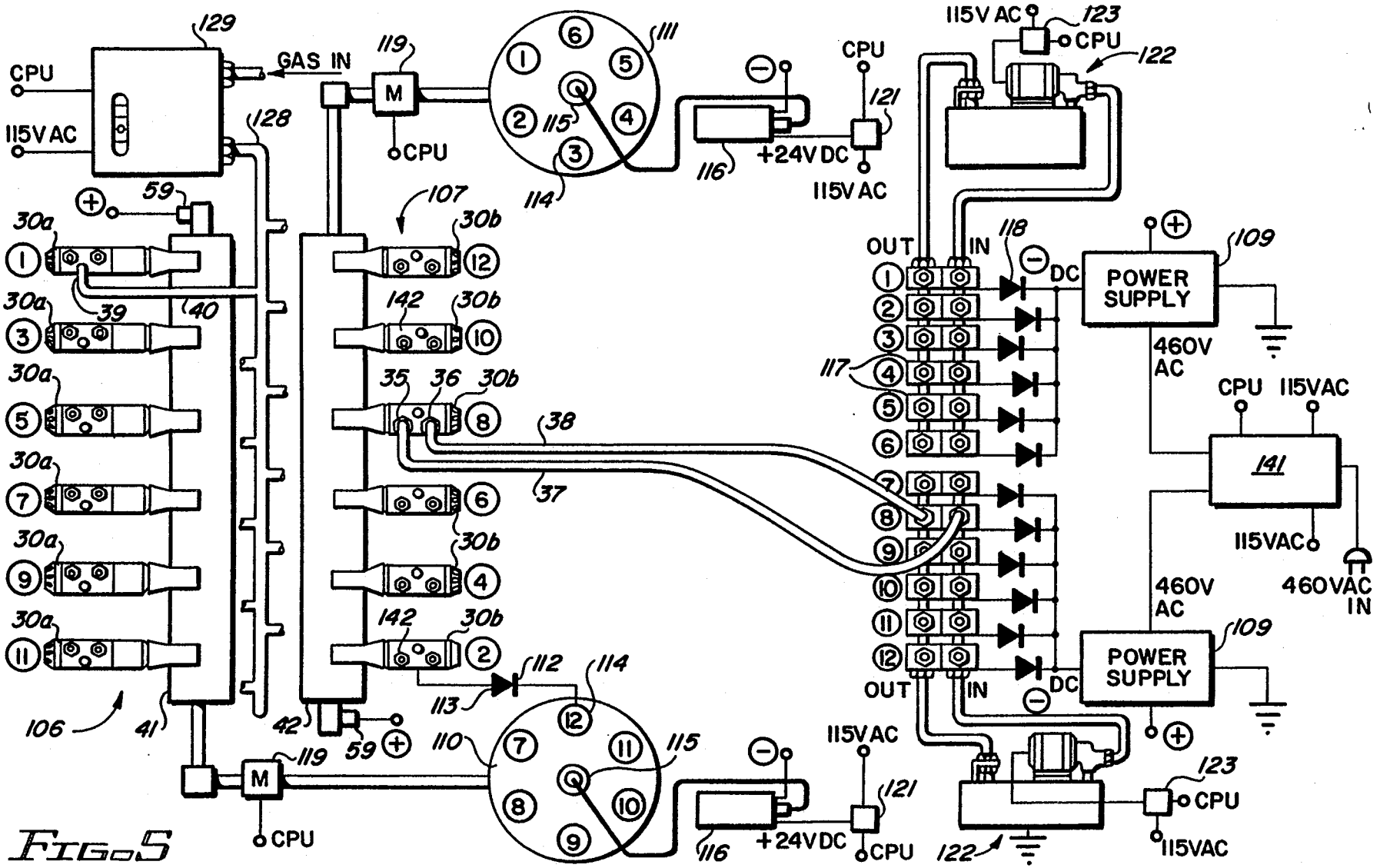
Figure 6:
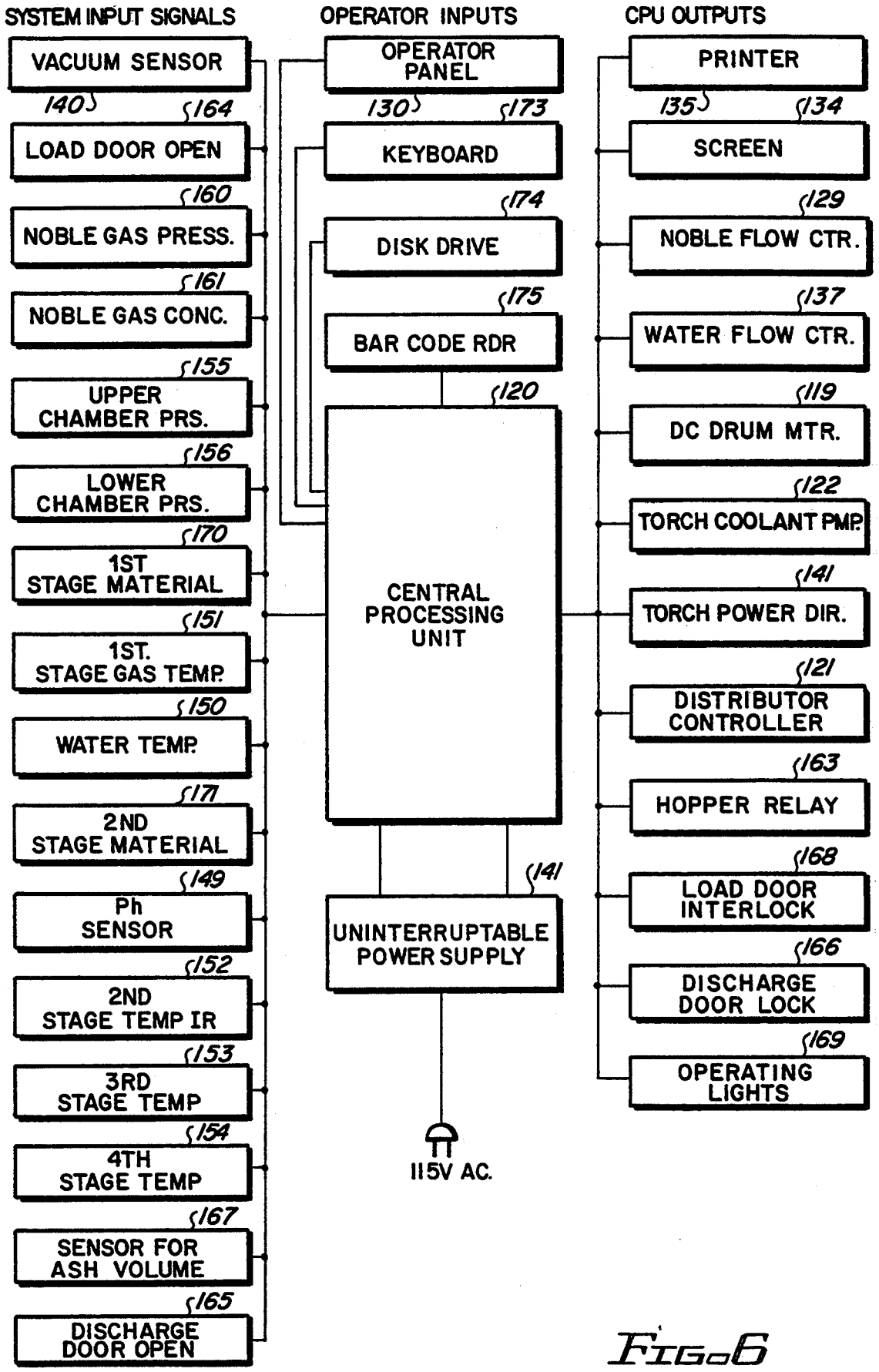

FIG. is a section view taken along the line 2—2 of FIG. 1;

FIG. 3 is an enlarged view of a portion of the incinerator of FIG. 1;

FIG. 4 is a fragmentary section view taken along the line 4—4 of FIG. 3;

FIG. 5 is a schematic drawing of the control system for the torches of FIGS. 1 and 3; and FIG. 6 is a block diagram of the control circuitry of the incinerator of FIG. 1.

Throughout the drawings, like elements are referred to by like numerals.

DETAILED DESCRIPTION OF PREFERRED EMBODIMENTS

The principles of the invention are described with reference to an incinerating system 10, shown in FIGS. 1–6, usable for the on-site disposal of biohazardous waste, in a process which incandescently burns the waste, retains the products of combustion, and leaves a nonhazardous, readily manageable solid residue.

As shown in FIG. 1, the incinerator 10 comprises a sealed enclosure 12 having stainless steel walls 14, internally lined with a high temperature ceramic liner 15, and externally insulated with a jacket of ceramic glass fiber 16. The enclosure 12 defines a combustion chamber 18 with upper, first level intermediate, second level intermediate and lower chamber portions 19, 20, 21, 22, arranged in serial internal communication.

The upper chamber portion 19 comprises an inclined load ramp or chute 23. A normally closed, openable access door 24, located in sealing engagement at an upper end of chute 23 provides means through which combustible containers 25 of biohazardous waste can be loaded for gravity feed down the incline toward the first intermediate chamber portion 20. The containers 25 may be of any shape and composition suitable for temporarily enclosing and containing biohazardous waste, including waste in the form of "sharps" such as used syringe needles and the like. The illustrated ramp 23 has a general rectangular shaped cross-section (see FIG. 2) and, for convenience of gravitational feed, the containers 25 are cylindrical metal containers, placed into the chute with their cylindrical axes oriented parallel to the rectangular cross-section. This enables the containers to be rolled down the chute 23.

Figure 2:
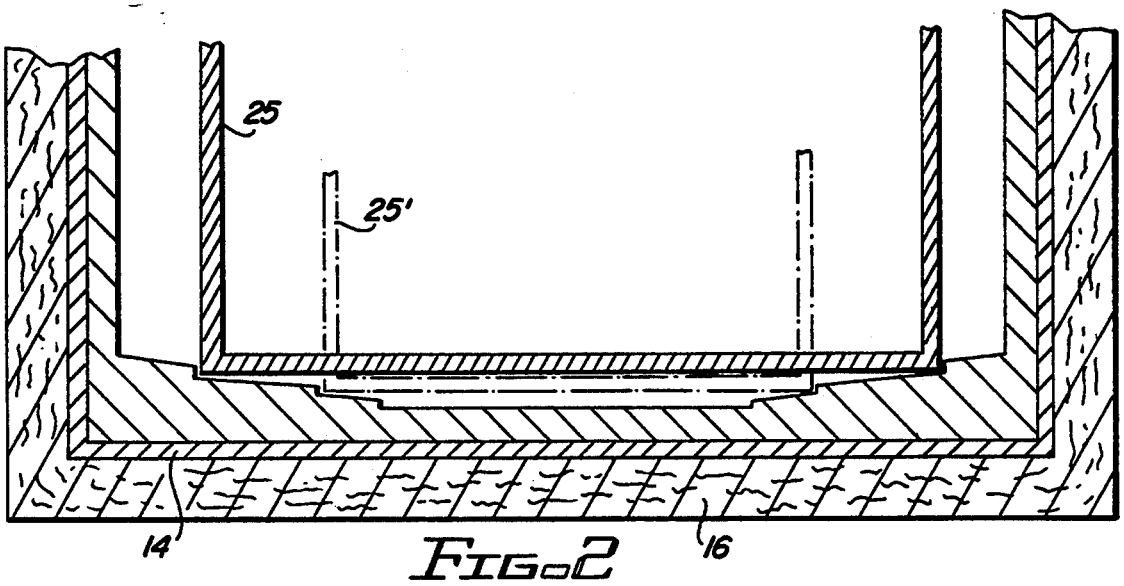

In order that different sizes of cylindrical containers 25 will be self-centering in chute 23, the part of liner 15 that forms the surface on which the cylinders roll is given an inwardly lower, stepped cross-sectional configuration, as shown in FIG. 2. By incrementally expanding the vertical dimension of the upper chamber portion 19 downwardlytoward the center of the bottom run of chute 23, metal containers 25, 25' of different axial lengths (indicated by solid and dot-dashed lines in FIG. 2) will self-center as they roll down the incline toward the top end of the first intermediate chamber portion 20. In addition to the self-centering benefit, the stepped configuration of the bottom run helps keep the upper chamber portion clean by allowing debris to roll down the center trough. The cross-sectional configuration of chamber 18 remains generally uniform throughout the length of upper chamber portion 19. The internal dimensions of the cavity of chute 23 are selected to be slightly larger than the corresponding external dimensions of the largest cylinder 25 expected to be accommodated. The illustrated chute 23 has an upper part, inclined at 30° and able to accommodate a stack of four of the largest cylinders 25*b*–25*e*, then bends downward to an almost vertical part into which another leading cylinder 25*a* can drop.

The first level intermediate portion 20 has a vertically descending internal cavity 26 (see FIG. 3), whose upper end continues the lower end of the vertical part of the chute 23, in a smooth transition. Cavity 26 begins with the same cross-sectional dimensions as chute 23, but then decreases to dimensions less than the dimensions of the smallest container 25 expected to be accommodated, to provide a first constriction 27 (FIG. 1) that functions to stop further descent of the leading container 25a, until it is opened and its contents emptied, as further described below. The constriction 27 is defined in part by a downwardly and inwardly, smoothly and continuously reduced inside diameter portion of the liner 15 which also serves as a holder for a plurality of banks of oppositely directed first level, elongated TIG (tungsten inert gas) torches 30. As seen in FIG. 3, each torch 30 is an electric arc transfer torch having a blunted, leading end 31 with a torch electrode 32 axially-disposed within an annular, gas delivering nozzle 33. The torches 30 are mounted in the liner 15, with the nozzle 33 opening into the chamber portion 20 and a trailing body end 34 projecting through wall 14, externally of enclosure 12. The body end 34 has fittings 35, 36, to which the ends of flexible, hollow copper cables 37, 38 (FIG. 5) are releasably joined to electrically connect the electrode 32 to one terminal of a source of electrical power, and also to act as conduits to supply water or other cooling fluid to the torch 30, as discussed below. The torches 30 also include fittings 39 to which the ends of tubes 40 (FIG. 5) are connected for delivery of an argon/ helium or other suitable noble gas Attorney Docket 10088.2 mixture for discharge from nozzle 33, at the constriction 27.

Identical, laterally-spaced, hollow metal drums 41, 42 (FIGS. 1–3) are respectively located below the leading ends 31 of torches 30, to form the lowest and innermost part of the first constriction 27. Each drum 41, 42 comprises a cylindrical shell 44, mounted by means of opposite, circular end caps 45 for rotation about a central, axial shaft 47 (FIGS. 3 and 4). The ends of each shaft 47 pass through openings 43 in walls 14 of enclosure 12, and are journalled externally by pillow block bearing assemblies 48, for rotation about axes 49 which, in the illustrated arrangement, are parallel to the cylindrical axes of the loaded containers 25. End caps 45 are provided with vent apertures 51 to dissipate heat from the interiors 52 of the drums 41, 42, through passages 53 in the lining 15, back to the chamber 18, at points below the drums 41, 42. Cylindrical bellows seals 55 project coaxially inward about shafts 47 from wall 14 to end caps 45, for sealing the voids created by openings 43 to shield against the escape of heat and gas where the shafts 47 pass through the enclosure 12. One end of each bellows 55 is attached to a metal ring 56 attached to wall 14 to extend marginally, annularly into the associated opening 43. The other end of each bellows 55 is provided with a ring-shaped graphite brush 58, biased into contact with the adjacent end cap 45, and located between the openings 51 and the shafts 47. The external surfaces of the shells 44 are connected by means of spring-loaded, electrical contact brushes 59 which drag on the outside of the shaft 47, to the other terminal of the electrical power source to enable current to flow from the torch electrodes 32 to the drums 41, 42 through the medium of the released argon/helium mixture when the first level torches 30 are fired.

The torches 30 are preferably mounted relative to the drums 41, 42 so that their axes of elongation 60 (viz. the axes of electrodes 32) are at 14° tilt angles "A" (FIG. 3) to tangents 61 drawn horizontally at the tops of the shells 44. The ends 31 are made blunt, cut perpendicular to the torch axes 60, so that the ionized gas flames 62 (dot-dashed lines in FIG. 3) produced between the electrodes 32 and the drum surfaces 44 will be spread out and deflected, to flicker or oscillate up and down. The nozzles 33 are preferably located to discharge the gas over the tops of drums 41, 42, starting at about 30° outwardly (30° clockwise as shown in FIG. 3) of the points of horizontal tangency.

Drums 41, 42 are accommodated to rotate in counter-rotation, so that adjacent surfaces of shells 44 move in the same direction, as indicated by the directional arrows in FIGS. 1 and 3. This action, together with close tolerances at 61 between the liner 15 and drums 41, 42 at the gas spread starting points and the installation of wipers 63 disposed at the innermost projection of drums 41, 42, directs solid waste material emptied from the leading container 25*a* through the flame area 62 and into the throat of a second constriction 64 (FIG. 1) provided in the underlying second level intermediate chamber portion 21, below. The wipers 63 include upwardly directed, knife-blade shaped wiping edges 65 dimensioned, configured and adapted to wipe solid materials away from the outside surfaces of the drums 41, 42.

The second level intermediate chamber portion 21 is characterized by a second constriction 64 (FIG. 1), whose narrowest point is defined by a nip 66 formed between two laterally-spaced drums 67, 68. Drums 67, 68 comprise hollow shells with end caps, and are respectively mounted below drums 41, 42, using external pillow blocks, cylindrical bellows and heat venting arrangements like those employed for drums 41, 42. Drum 68 has a ribbed, cylindrical outer surface 69 (FIG. 3), and has a diameter approximately two and one-half times the diameter of drums 41, 42. Drum 68 is mounted for rotation about an axis 70 parallel to the axes 49. Drum 68 is located so that the innermost point of drum 42 (the point where knife-blade 65 scrapes the surface of drum 42) is preferably radially, directly above axis 70. Drum 67, which has a smooth outer surface, may be of identical size as drums 41, 42 and is located for rotation about an axis 71 parallel to, and on a common horizontal plane with, axis 70. Drum 67 is located outwardly (to the left in FIG. 1) of drum 41, and drum 68 is dimensioned relative to the sizes and spacing of drums 41, 42 so that the entire narrowest part of the first constriction 27 (defined by the lateral spacing between drums 41, 42) will be positioned above the outer surface of drum 68, above an arc extending 30°–45° counterclockwise (as shown in FIG. 1), from the top (point closest to the knife-edge) of drum 68.

Drums 67, 68 are adapted to be rotated in the same direction, so that adjacent ones of their surfaces move in opposite directions, with the outer surface of drum 68 moving downwardly toward the throat 64 and the outer surface of drum 67 opposing such downward movement. The bottom of wiper assembly 63 has a portion 73, provided with an arcuate concavity 74, disposed between the drums 42, 68. A tight tolerance between the assembly 63 and the ribbed surface 69, combined with a counterclockwise rotation of drum 68, keeps solid materials from traveling outwardly behind drum 68. A plurality of vertically spaced second level torches 75, which may be of the same kind as first level torches 30, discussed above, are located between the drums 41, 67 with their nozzles 33 directed generally horizontally toward the surface 69 of drum 68. The upper torches 75*a* are pointed at the part of surface 69 located below the innermost part of drum 42, and the lower torches 75*b* are pointed at the part of surface 69 located below the innermost part of drum 41. The nip 66, representing the narrowest part of the second constriction 64 defined by the lateral spacing between drums 67, 68, is far more severe than the first constriction 27, and serves to define the largest size of particle of solid combustion product material that is able to pass from the second level intermediate chamber portion 21 to the lower chamber portion 22.

A collection point for combustion product material is provided below nip 66 in an expanded region 80 (FIG. 1) provided in the lower chamber portion 22. The bottom of region 80 is defined by the inside surfaces of opposing, movable clam-like jaws 82, 83 of a hopper 85. Horizontal, externally oppositely directed passages 86, 87, accommodated with one-way check valves 89, lead from the upper part of region 80 through walls 14 to external ejector venturi scrubber assemblies 90 which discharge into waste water collection manifold passages 92. The tops of the scrubbers 91 are attached to conduits 94 by means of which water is passed through the scrubbers.

A solid residue collection point is located below the hopper 85 in the bottom part of lower chamber portion 22. The collection point comprises an open-topped bin 96 into which solid material accumulated in the hopper 85 can be emptied by opening the jaws 82, 83. Access to the bin 96 is provided by a locking discharge door 97 located at the base of the incinerator 12.

For recirculation of byproduct gases from the top of the chute 23 in the upper chamber portion 19 to the second level intermediate chamber portion 21, a gas return manifold 100 is provided that runs externally of the chamber 18. Manifold 100 includes connecting dual conduits 101 that are wrapped by copper coils 103, through which water or other cooling fluid can be flowed. The conduits 101 are connected to return pipes 104 which have lower end discharge ports 105 located to empty out in the vicinity just above the nip 66 in the second level intermediate chamber portion 21.

FIG. 5 shows, in schematic form, an overview of a firing system suitable for firing the first torches 30 of the system 10. A similar arrangement can be used to fire the upper and lower ones of the second level torches 75. The illustrated arrangement shows two banks 106, 107 of six first level torches 30 each—the torches 30*a* of bank 106 being located in longitudinally-spaced positions relative to drum 41, and the torches 30*b* of bank 107 being located in like longitudinally-spaced positions relative to drum 42. The drums 41, 42 are connected, as already stated, to one terminal of a power supply 109 by means of brushes 59, described above with reference to FIG. 4. Shafts 47, end caps 45 and shells 44 are electrically conductive to place the drum surface at the same electrical potential as the polarity of the one terminal. The electrodes 32 of torches 30 (FIG. 3) are connected to the other terminal of the same power supply 109 in two ways—one is a high voltage, low amperage connection for initial torch ignition or firing, and the other is a low voltage, high amperage connection for sustaining the flow between the electrode and the drum, once firing has occurred. The high voltage, low amperage connection is accomplished by means of distributor assemblies 110, 111, which may be similar to those used in an automobile ignition system to fire spark plugs of an internal combustion engine. The electrodes 32 are respectively connected through conductive cables 112 via diodes 113 to different ones of uncommon contact points arranged circumferentially about the distributor 110 or 111. The common contact point 115 of each distributor 110 or 111 is electrically connected via a high voltage coil 116 to the other terminal of the power supply. The low voltage, high amperage connections are accomplished by connecting the conductive cooling fluid delivery and return cables 37, 38 to respective fittings of isolated cable adapters 117, and connecting those adapters 117 via diodes 118 to the one terminal side of power supply 109. The shown arrangement connects the drums 41, 42 to the anode side of the power supply 109, and the electrodes 32 to the cathode side. The diodes 113, 118 ensure that the high voltage from common contact point 115 will be connected to only one torch 30 at a time. Placing the brushes 59 between the block assemblies 48 and the walls 14 of enclosure 12, as shown in FIG. 4, prevents electrical arcing at assemblies 48.

The distributors 110, 111 are arranged so that their rotors which make and break electrical connection between the common and uncommon contacts 114, 115, are driven in synchronism with the rotation of drums 41, 42. This is achieved by using common motor mechanisms 119 to drive both the rotors of distributors 110, 111 and the corresponding drum shafts 47. Operation of motors 119 is under the control of a microprocessor CPU 120 (FIG. 6), as is the regulation by means of voltage controllers 121 of the coil voltage.

Coolant is supplied to the torches 32 through the same cables 37, 38, via pump assemblies 122 which are controlled by a coolant pump relay 123, also under control of CPU 120. Coolant is delivered from the pumps 122 through common nonconductive conduits 125 to the separate cable adapters 117, and from there by means of the respective conductive cables 37 to the torches 30. After circulation through the electrodes 32, coolant is returned through the conductive cables 38 back to the adapters 117, and from there by common nonconductive conduits 126 back to the pumps 122.

Noble gas flow, such as the flow of argon and helium mixture, is ported to the annular region surrounding electrodes 32 of the torch nozzles 33 by a conduit network 128, regulated by a controller 129 which is under the supervision of the same CPU 120. A block diagram of the control circuit of system 10 is shown in FIG. 6.

The system's operation begins when an operator controlled start button is activated on the operator panel 130. This activates the CPU 120 to initiate preheating of the system and start-up testing to determine the operating readiness of the various system components. Information relating to preheating and start-up testing is displayed on an operator screen 134 and also on a printer 135.

Once system readiness is determined, one or more unopened metal waste containers 25 (FIG. 1) are loaded into the chute 23 of the upper combustion chamber portion 19 of enclosure 12 through door 24. The stepped cross-section of the ramp floor (see FIG. 2) ensures that each container 25 will center itself within chute 23. After loading the system, door 24 is closed to seal enclosure 12 and a slight vacuum is drawn in chamber 18 through activation of a water flow controller 137 which actuates relays 123 (FIG. 5) to circulate water through the venturi scrubbers 90. The water that flows through scrubbers 90 may be provided as a separate system, or may be connected to be in the same flow path as the water that passes through the copper cooling coils 103 which wrap around the gas recirculation conduits 101.

After an acceptable vacuum signal is received by the CPU 120 from a vacuum sensor 140, the CPU 120 activates the torch firing system shown in FIG. 5. A torch power director 141 (FIGS. 5 and 6) turns on the torch power supplies 109. These are constant current DC power supplies with sufficient amperage to ignite multiple arc torches 30, 75. Arcing is initiated by high voltage power supplied to the brass fitting block 142 (FIGS. 3 and 5) of each torch by a different cable 112 from the distributors 110, 111 in the firing order sequence indicated by the numbered circles in FIG. 5. Low voltage, high amperage power to sustain the arcing is directed to each torch 30, 75 through isolated power cable adapters 117 and the conductive coolant cables 37, 38. With the torches 30, 75 ignited, arcing occurs between the electrodes 32 and the drums 41, 42, 67, 68, through the ionized noble gas mixture released at the nozzles 33 (FIG. 3), whereby incandescent heat is generated.

The containers 25 advance under action of gravity, downward through chute 23 until the leading container **25*a* reaches the first constriction 27 (FIG. 1). At this point, the heat generated by the arcing between torches 30 and the drums 41, 42 begins to melt the lowermost container 25*a*, thereby opening it and spilling its contents out into the intense heat. High temperature gases generated by the incandescent burning of the spilled biohazardous waste rise up into the upper chamber portion 19 which holds the remaining unopened biohazardous waste containers 25*b*, 25*c*, 25*d* and 25*e*. These heated byproduct gases act as first stage "cookers" of biohazardous waste in the yet unopened containers 25, to reduce the volume of material in those containers before the incandescent action of the second stage is reached. The opened container 25*a* restricts some of the upward gas flow and concentrates the trapped hot gases within the interior of the now open container 25*a***.

The hot gases rising into the upper chamber portion 19 to act as the motive for first stage "cooking," flow into the collector dome manifold 100, located just below the door 24. The gases collected in manifold 100 pass to return pipes 104, where they are cooled by water passing through the coils 103 which wrap around the pipes 104. The cooled gases then pass down the pipes 104, and reenter chamber 18 in the intense heat region vicinity of torches 75 at constriction 64. The alternate heating and cooling of the gases causes a recirculation that encourages complete combustion and decomposition of primary byproduct gases and ash suspended in those gases. As the first stage of the disposal process reaches its gas volume maximum capacity, the cooler and heavier recirculated gases drop into the lower chamber portion 22 and exit the system via the scrubbers 90. Because they are lighter, the noble gases released by the torches have a greater tendency to remain in the upper and intermediate chamber portions 19, 20, 21.

The first and second stages of the process are monitored and controlled by CPU 120 which receives input from various sensors, as indicated in FIG. 6. Water flowing through coils 103 and scrubbers 90 is regulated by CPU 120 through activation of a water flow controller 137, in response to signals received from Ph sensor 149 which measures the acidity of water in the scrubber waste water, temperature sensor 150 which measures the temperature of the scrubber waste water, chamber temperature sensors 151–154 that measure temperature in the respective chamber portions, and chamber pressure sensors 155, 156 that measure pressure respectively in the upper and lower chamber portions. The volume of noble gas flow to the second stage torches 30, 75 is regulated by CPU 120 through noble gas flow controller 129 (FIG. 5) in response to signals received from the noble gas pressure and noble gas concentration sensors 160, 161.

The blunting and angling of torches 30 causes a deflected electric flame area of large width and flame spread, as discussed above in reference to FIG. 3. The argon and helium noble gas mixture not only acts as the motive of arc transfer between the electrodes 32 and the drums 41, 42, but also provides shielding of each torch's tungsten electrode 32 from oxidation by the biohazardous waste byproducts. The torch's "blunt" or flat end motivates the arc flame 62 (FIG. 3) to wander or oscillate between the biohazardous waste material and the compactor drums. The flame reaches a temperature of 7000° F. or more. The torches 30, 75 are cooled by water recirculated under control of relay 123 (FIG. 5) through metallic cables 37, 38 that also connect the electrodes 32 to the arc sustaining power supply 109. Ignition of the torches 30, 75, as already mentioned, is achieved by discharging a high voltage capacitor coil 116 through a diode 113 to each separate torch 30, 75. Ignition of the torches proceeds sequentially through a distributor 110, 111 as indicated by the terminal numberings in FIG. 5. The distributor 110, 111 can be driven from the same motor shaft that drives the drums. As each torch fires, one of two reactions occur. If the flame arc is out, it will be ignited. If the flame is already present, the firing discharge will provide a temporary flame intensification which causes a mechanical disturbance that serves to agitate solid wastes, and move them through the system.

The third stage of the process involves treatment of the waste by contact with the first and second level sets of drums 41, 42 and 67, 68. Drums 41, 42 are heated by arcing from torches 30 and drums 67, 68 are heated by arcing from torches 75. Drum temperature is controlled by means of control of the speeds of the DC motors 119 used to drive the drums. Drum temperature is maintained at around 2200° F., and is monitored by suitably located temperature sensors 153 connected to provide feedback signals to CPU 120. Each drum may have its own motor, so its temperature can be maintained independently of the temperatures of the other drums.

The first level drums 41, 42 are identically-sized small drums both with smooth surfaces. The drums 40, 41 meet the leading container 25a, counterrotating inwardly toward the captured container 25a, to melt the container walls and lay the solid and liquid byproducts of the first and second stages onto the large, second level ribbed drum 68. Material is carried on the large drum 68 into the throat of downwardly converging constriction 64, and into the extreme heat produced by the upper and lower rows of the second level, incandescent arc flame torches 75. The smooth small drum 67, laterally-spaced from drum 68 at the narrowest part of the constriction 27, rotates in the same direction as the large drum 68. This action maintains solid waste residue in the hottest part of the chamber 18, until the total heat exposure time has exceeded the minimum requirement and until the solids have been reduced to particle sizes small enough to pass through the nip 66 between drums 67, 68.

At the completion of the third stage, waste residue ash is deposited into the hopper 85 in the lower chamber portion 22. The temperature of the ash is monitored by a sensor 154 until released into the underlying collection bin by CPU signal to a hopper relay 163 which opens the hopper jaws 82, 83.

The loading and unloading of chamber 18 is also supervised by means of CPU 120. Loading and unloading is only allowed when the temperatures and pressures are within acceptable limits. CPU 120 reads signals from the temperature sensors 151–154 and pressure sensors 155, 156 before signalling a discharge door lock 166 to release the discharge door 100 providing access to the bin 96. Likewise, temperature and pressure must be within acceptable limits before additional containers 25 can be loaded into chute 23 through door 24. Sensors 164, 165 detect when the doors 24, 97 are open. Ash volume in the bin is monitored by sensor 167. If ash volume has reached a predetermined maximum volume, CPU 120 will not disengage the load door interlock 168 to allow the loading of additional waste containers 25 until the already present ash has been removed. CPU 120 sends signals to the operating lights 169 to give visual notice to the operator of system status. The presence of containers 25 in chamber portions 19, 20 is detected by sensors 170, 171, respectively.

The CPU 120 is also connected for electrical communication with a keyboard 173, a disk drive 174 and a bar code reader 175. It is foreseen that destruction of specific ones of the containers 25 can be verified through use of individually assigned bar code labels which can be attached to the containers and typed or scanned into memory of CPU 120. CPU 120 can then monitor and verify disposal of specific units and record the same on disk and/or on hard copy printout. Such procedure may be useful, for example, in the disposal of hospital waste units (viz. bad blood units) which are identified by preassigned bar code numbers. Duplicate bar codes can be attached to the containers 25 which serve as temporary repositories for the units. Then, when the containers are processed by system 10, the labels can be read into CPU 120 and destruction of the individual units confirmed by printout and disk stored data.

As described, the invention provides a system for processing biohazardous waste where high incandescent heat burns the material in a controlled noble gas atmosphere which renders the processed waste nonbiohazardous by destroying germs, virus, and other harmful microorganisms through exposure to the intense heat generated within the process. The heat source is generated through a torch flame to destruct the shape of the material, burn the material, and change the waste material composition to render it to solid waste ash. The flame is electrically generated through a constant DC current power supply and electric TIG arc transfer torches, using noble gases as the motive for arc transfer. The electric arc torches are configured and arranged to widely distribute the flame's heat, and cause the flame to wander or oscillate.

The use of common drum anodes and sharing of power sources among cathode electrodes of torches has two advantages. One, is a reduction in the amount of total power needed for torch operation. The other is the transfer of shared power to a single electrode of a shorted arc until the short is removed. This applies a high amperage through any particle of unwanted waste material stuck between an electrode and a drum. As a piece of waste touches an electrode, and if a shorted arc does not have sufficient amperage to incandescently burn the waste from the electrode, the full power amperage of the power source is redirected from the power source sharing torches of the same bank, to the electrode with the short until the waste burns off. After the short is removed, all shared electrode torches are refired and flames lit by the distributor and capacitor discharge.

The high temperatures at which the surfaces of the rotating drums are maintained sterilizes and destroys any bacteria, germs, and other harmful microorganisms. The generated gases are recycled to improve combustion and cleaned by scrubbing, before being vented off in a waste water motive. Ozone byproduct generated by the torches acts as a disinfectant in the waste water. As the gases are scrubbed and cooled to 150° F., the ozone is suspended in the water motive. Gas pressure and temperature, and motive water temperature and Ph balance are controlled by the control of flow of motive water through the ejector venturi. The waste water then passes through a standard water trap and the cooled, cleaned gases can be vented to the atmosphere or discharged in another acceptable conventional manner.

Those skilled in the art to which the invention relates will appreciate that other substitutions and modifications can be made to the described embodiment without departing from the spirit and scope of the invention as described by the claims below.

What is claimed is:

1. An incinerator for the processing of waste, comprising:

a sealed enclosure defining a combustion chamber having upper, intermediate and lower chamber portions;

said upper chamber portion comprising means for introducing waste into said enclosure;

said intermediate chamber portion comprising an internal cavity communicating with said upper chamber portion to receive said introduced waste and including a constiction; at least one drum located in said internal cavity at said constriction; at least one arc transfer device arranged adjacent said drum; and means providing arcing between said arc transfer device and said drum for generating heat; said constriction and drum being relatively dimensioned, configured and adapted to deliver said received waste into said heat; and said lower chamber portion communicating with said internal cavity and said constriction for receipt of residue produced by action of said heat on said waste.

2. An incinerator as in claim 1, wherein said arc transfer device comprises an electric arc transfer torch having an electrode; and wherein said means providing arcing comprises means connecting said electrode to a first terminal of an electrical power source, and means connecting said drum to a second terminal of said electrical power source.

3. An incinerator as in claim 2, wherein said incinerator further comprises a hollow cable connected to supply cooling fluid to said torch; and wherein said means connecting said electrode to said first terminal comprises means connecting said hollow cable to said power source.

4. An incinerator as in claim 2, wherein said drum comprises a shaft, and a hollow metal shell mounted on said shaft; wherein said shaft has an end passing externally through said enclosure; and wherein said means connecting said drum to said second terminal comprises an electrical contact brush positioned to drag on said shaft end.

5. An incinerator as in claim 2, wherein said torch is an elongated member having an axis of elongation and a blunted leading end with an annular, gas delivering nozzle; said electrode is axially-disposed within said gas delivering nozzle; said drum has a cylindrical shell with a top; and said torch is mounted with said axis of elongation at a 14° tilt angle to a tangent drawn horizontally at said top.

6. An incinerator as in claim 5, wherein said nozzle is positioned relative to said drum, to discharge gas over said top at 30° outwardly, away from said nozzle, of a point of tangency of said tangent with said top.

7. An incinerator for the processing of waste, comprising:

a sealed enclosure defining a combustion chamber having upper, intermediate and lower chamber portions;

said upper chamber portion comprising means for introducing waste into said enclosure;

said intermediate chamber portion comprising an internal cavity communicating with said upper chamber portion to receive said introduced waste and including a constriction; first and second drums located in said internal cavity, laterally spaced across said first first constriction; first and second arc transfer devices, respectively arranged adjacent said first and second drums; and means providing arcing between said arc transfer devices and said drums for generating heat; said constriction and drums being relatively dimensioned, configured and adapted to deliver said waste into said heat; and said lower chamber portion communicating with said internal cavity and said constriction for receipt of residue produced by action of said heat on said waste.

8. An incinerator as in claim 7, further comprising means rotating said drums in counterrotation, with adjacent surfaces of said drums moving in downward

9. An incinerator as in claim 8, wherein said drums have cylindrical outside surfaces; and further comprising first and second wipers respectively disposed at innermost projections of said first and second drums; said wipers including upwardly directed knife-blade shaped wiping edges dimensioned, configured and adapted for wiping solid materials away from said drum outside surfaces.

10. An incinerator as in claim 7, wherein said constriction is a first constriction; and wherein said intermediate chamber portion further includes a second constriction; third and fourth drums located in said internal cavity, laterally spaced across said second constriction; a third arc transfer device arranged adjacent said third drum; and means providing arcing between said third arc transfer device and one of said third and fourth drums for generating additional heat; said second constriction and third and fourth drums being relatively dimensioned, configured and adapted to deliver said waste also into said additional heat.

11. An incinerator as in claim 10, wherein said third drum has a rotational axis; wherein said first drum has an innermost part closest to said second drum; and wherein said third drum is located so that said innermost part is located radially of said third drum relative to said third drum rotational axis.

12. An incinerator as in claim 11, wherein said third drum is larger than said fourth drum; said third drum includes an outer surface; said second drum has an innermost part closest to said first drum and spaced across a gap from said first drum innermost part; and said third drum is positioned so that all of said gap is located above said third drum outer surface.

13. An incinerator as in claim 12, wherein said third drum has a top in line with said radius between said third drum rotational axis and said first drum innermost part; and wherein said third drum and gap are relatively dimensioned, configured and adapted so that all of said gap is positioned above said third drum outer surface on an arc extending 30°–45° from said third drum top in a direction toward said fourth drum.

14. An incinerator as in claim 13, further comprising means moving said third and fourth drums in the same rotational direction, with surfaces of said third drum adjacent said fourth drum moving downwardly, and surfaces of said fourth drum adjacent said third drum moving upwardly.

15. An incinerator as in claim 14, wherein the spacing between said third and fourth drums is less than the spacing between said first and second drums.

16. An incinerator as in claim 15, further comprising a conduit connecting said upper chamber portion with said second constriction outside of said internal cavity, said conduit being dimensioned, configured and adapted for recirculating heated gases between said upper chamber portion and said intermediate chamber portion.

17. A method for processing waste, comprising the steps of:

providing an enclosure defining a combustion chamber having upper, intermediate and lower chamber portions;

introducing the waste into said enclosure at said upper chamber portion;

generating heat at a constriction of an internal cavity in said intermediate chamber portion by arcing between a drum located in said internal cavity at said constriction and an arc transfer device arranged adjacent said drum;

delivering the waste to said constriction to be acted upon by said generated heat; and delivering solid residue of said action of said heat on said waste to said lower chamber portion.

18. A method as in claim 17, wherein said arc transfer device is an electric arc transfer torch having an electrode; and wherein, in said heat generating step, said electrode is connected to a first terminal of an electrical power source, and said device is connected to a second terminal of said electrical power source.

19. A method as in claim 18, wherein in said introducing step, the waste is introduced into said enclosure contained in a plurality of closed containers; wherein, in said delivering step, said containers are delivered by means of gravitational feed; and wherein, in said heat generating step, said heat is generated by arcing between a plurality of drums and a plurality of torches respectively arranged adjacent said drums, said drums being laterally spaced across said internal cavity and acting to block further gravitational feed of a leading container until said leading container size has been reduced.

20. A method as in claim 17, further comprising a step of recirculating gases which are generated by said action of said heat on the waste and which rise to said upper chamber portion through said internal cavity, back to said constriction outside of said internal cavity.

* * * * *